US012543832B2

(12) United States Patent
Cai

(10) Patent No.: US 12,543,832 B2
(45) Date of Patent: Feb. 10, 2026

(54) CARD CASE

(71) Applicant: Shenzhen Aoji Technology Co., Ltd., Shenzhen (CN)

(72) Inventor: Jing Cai, Dongguan (CN)

(73) Assignee: Shenzhen Aoji Technology Co., Ltd., Shenzhen (CN)

( * ) Notice: Subject to any disclaimer, the term of this patent is extended or adjusted under 35 U.S.C. 154(b) by 0 days.

(21) Appl. No.: 18/963,699

(22) Filed: Nov. 28, 2024

(65) Prior Publication Data

US 2025/0089868 A1 Mar. 20, 2025

(30) Foreign Application Priority Data

Jun. 18, 2024 (CN) ..... 202421385777.X

(51) Int. Cl.
*A45C 11/18* (2006.01)
*A45C 1/06* (2006.01)

(52) U.S. Cl.
CPC ..... *A45C 11/182* (2013.01); *A45C 1/06* (2013.01); *A45C 2001/062* (2013.01)

(58) Field of Classification Search
CPC .... A45C 11/182; A45C 1/06; A45C 2001/062
See application file for complete search history.

(56) References Cited

U.S. PATENT DOCUMENTS 3,446,260 A * 5/1969 Osher ..... A45C 1/06 150/147
4,570,688 A * 2/1986 Williams ..... A45C 1/06 224/604
4,964,508 A * 10/1990 Balsley ..... A45C 11/32 206/38.1
5,244,024 A * 9/1993 Oosthuizen ..... A45C 1/06 150/139
5,506,395 A * 4/1996 Eppley ..... G06K 19/02 150/147
7,546,860 B1 * 6/2009 Mehdizadeh ..... A45C 11/18 150/147
11,439,214 B2 * 9/2022 Tran ..... B25F 1/04
D1,009,465 S * 1/2024 Zeng ..... D3/249
11,969,066 B1 * 4/2024 Zeng ..... A45C 1/06
2018/0310681 A1 * 11/2018 Wingerter ..... B42F 17/32
2018/0332936 A1 * 11/2018 Serman ..... A45C 11/182
(Continued)

FOREIGN PATENT DOCUMENTS

CA 2307751 A1 * 4/2001 ..... A45C 11/182
CN 221082969 U * 6/2024 ..... A45C 11/182

*Primary Examiner* — Don M Anderson
*Assistant Examiner* — Justin Caudill

(57) ABSTRACT

A card case includes a flexible member and a card box. The flexible member is provided with a first holding groove and a first opening, and the first opening is in communication with the first holding groove, and a direction faced by the first opening is a first direction; a card box is connected to the flexible member, the card box is provided with a second holding groove and a second opening, and the second holding groove is configured to hold cards or banknotes; the second opening is in communication with the second holding groove, and a direction faced by the second opening is a second direction, and the second direction is parallel to the first direction, or an angle is formed between the second direction and the first direction, and the angle is from 0° to 355°.

14 Claims, 4 Drawing Sheets

(56) References Cited

U.S. PATENT DOCUMENTS

| | | | | |
|---|---|---|---|---|
| 2018/0338593 | A1* | 11/2018 | Scharnigg | A45C 11/182 |
| 2021/0219685 | A1* | 7/2021 | Van Geer | B65D 83/08 |
| 2021/0282518 | A1* | 9/2021 | Schepper | A45C 11/182 |
| 2022/0061485 | A1* | 3/2022 | Rodriguez | G09F 3/207 |
| 2023/0225473 | A1* | 7/2023 | Lietzke | A45C 11/00 224/576 |
| 2023/0404226 | A1* | 12/2023 | Huang | A45C 15/00 |

* cited by examiner

CARD CASE

CROSS-REFERENCE TO RELATED APPLICATIONS

The present application claims priority to Chinese Patent Application No. 202323124777.2, filed Nov. 20, 2023, the entire disclosure of which is incorporated herein by reference.

TECHNICAL FIELD

The present application relates to the technical field of card cases, especially relates to a card case.

BACKGROUND

With the development of science and technology, it needs to use the card, such as a variety of IC cards, bank cards, supermarket cards, shopping cards, membership cards, etc., so many cards are not easy to store, easy in disorder, and often bring a lot of unnecessary trouble. The card case is used to manage many cards, and is a product of the modern economy.

In the related art, the existing card case includes a flexible member and a card box, the card box is connected to the flexible member, and the card box is configured to hold cards or banknotes. The flexible member can open or close the card box, the flexible member is in the closed state to cover a card outlet of the card box, and the card can only be taken out when the flexible member is in the opened state, which results in not convenience for card to be taken out of the existing card case.

SUMMARY

An object of the present application is to provide a card case. A flexible member is provided with a first holding groove and a first opening, the first holding groove is configured to hold cards or banknotes, and the first opening is in communication with the first holding groove, and a direction faced by the first opening is a first direction; a card box is connected to the flexible member, the card box is provided with a second holding groove and a second opening, and the second holding groove is configured to hold cards or banknotes; the second opening is in communication with the second holding groove, and a direction faced by the second opening is a second direction, and the second direction is parallel to the first direction, or an angle is formed between the second direction and the first direction, and the angle is from 0° to 355°, so as to adjust the angle between the second opening and the first opening, and thus control a direction where the card is taken out of the second groove and a direction where the card is taken out of the first groove, so that the direction where the card is taken out of the second groove and the direction where the card is taken out of the first groove are the same or the opposite, which improves the convenience for the card to be taken out of the card case, and thus realizes that the card is taken out of the card box when the flexible member is in a closed state.

In order to achieve the above purpose, the present application provides the following technical solution.

a card case, including:

a flexible member, provided with a first holding groove and a first opening, the first holding groove is configured to hold cards or banknotes, and the first opening is in communication with the first holding groove, and a direction faced by the first opening is a first direction;

a card box, connected to the flexible member, the card box is provided with a second holding groove and a second opening, and the second holding groove is configured to hold cards or banknotes; the second opening is in communication with the second holding groove, and a direction faced by the second opening is a second direction, and the second direction is parallel to the first direction, or an angle is formed between the second direction and the first direction, and the angle is from 0° to 355°.

In one embodiment, the second direction is the same as or opposite to the first direction, and an area of an opening space of the second opening is larger or smaller than an area of an opening space of the first opening; and the second holding groove is provided on a side of the first holding groove, and the first holding groove and the second holding groove are arranged at intervals and are used by a user selectively or synchronously.

In one embodiment, the second direction and the first direction are perpendicular to each other, and an area of an opening space of the second opening is larger or smaller than an area of an opening space of the first opening; and the second holding groove is provided on a side of the first holding groove, and the first holding groove and the second holding groove are spaced apart and are used by a user selectively or synchronously.

In one embodiment, the card box comprises a housing, an operation member, and a push card member;

the housing is connected to the flexible member, an inner side wall of the housing encloses to form the second holding groove, and the second opening is opened at an end of the housing and in communication with the second holding groove;

the operation member is movably connected to the housing and operable by a user, and the operation member is directly connected or indirectly connected to the push card member; and the push card member is located in the second holding groove, a position of the push card member is adjusted along with an activity of the operation member to push a card in the second holding groove.

In one embodiment, the operation member is provided on a circumferential side of the housing, and the operation member is provided with an operation end, the operation end is exposed to the housing and not covered by the flexible member.

In one embodiment, the push card member is swingably connected to the housing and swings within the second holding groove to push the card in the second holding groove;

the connection member is located between the push card member and the operation member and is configured to connect the push card member to the operation member;

the connection member is driven by the operation member to drive the push card member to swing; and the push card member is provided with a stepped groove, and a bottom of the stepped groove is configured to support a plurality of cards.

In one embodiment, the housing includes a first main body and a bottom cover, the bottom cover is connected to the first main body and forms the second holding groove with the first main body;

the first main body is a hollow tubular body, and the first main body is of square, special-shaped or round; and the first main body is formed by cutting aluminium extruded tube; or, the first main body is formed by processing metal parts.

In one embodiment, the flexible member includes a first portion and a second portion, the first portion and the second portion are flexibly connected and are opened or closed to each other; and when the first portion and the second portion are in a closed state, and the card box is located between the first portion and the second portion and is exposed to the first portion and the second portion along a lateral direction.

In one embodiment, an operation member of the card box is exposed to the first portion and the second portion, and is operable by a user;

the first holding groove is opened in the first portion or the second portion, and the first opening is in communication with the first holding groove; and the card box is connected to the first portion or the second portion, and the second opening is exposed in the first portion and the second portion for card insertion.

In one embodiment, the card box is connected to the first portion, a first money clip groove is formed between the card box and the first portion, and the first money clip groove is configured to hold banknotes;

the first money clip groove is provided with a third opening towards the second portion; or the card box is connected to the second portion, the second money clip groove is formed between the card box and the second portion, and the second money clip groove is configured to hold banknotes; and the second money clip groove is provided with a fourth opening towards the first portion.

Comparing with the existing technical solution, the technical effects of the present application includes:

The present application is to provide a card case. A flexible member is provided with a first holding groove and a first opening, the first holding groove is configured to hold cards or banknotes, and the first opening is in communication with the first holding groove, and a direction faced by the first opening is a first direction; a card box is connected to the flexible member, the card box is provided with a second holding groove and a second opening, and the second holding groove is configured to hold cards or banknotes; the second opening is in communication with the second holding groove, and a direction faced by the second opening is a second direction, and the second direction is parallel to the first direction, or an angle is formed between the second direction and the first direction, and the angle is from 0° to 355°, so as to adjust the angle between the second opening and the first opening, and thus control a direction where the card is taken out of the second groove and a direction where the card is taken out of the first groove, so that the direction where the card is taken out of the second groove and the direction where the card is taken out of the first groove are the same or the opposite, which improves the convenience of card to be taken out of the card case, and thus realizes that the card is taken out of the card box when the flexible member is in a closed state.

BRIEF DESCRIPTION OF THE DRAWINGS

In order to more clearly illustrate the technical solutions in the embodiments of the present application, the accompanying drawings to be used in the description of the embodiments will be briefly described below. Obviously, the accompanying drawings in the following description are only some of the embodiments of the present application, and other accompanying drawings may be obtained for those skilled in the art from these drawings without creative labour.

For a more complete understanding of the present application and its beneficial effects, the following description will be given in conjunction with the accompanying drawings. The same accompanying drawing symbols in the following description indicate the same parts.

DETAILED DESCRIPTION OF THE EMBODIMENTS

The technical solutions in the embodiments of the present application will be clearly and completely described below in conjunction with the accompanying drawings in the embodiments of the present application. Obviously, the described embodiments are only a part of the embodiments of the present application, and not all of the embodiments. Based on the embodiments in the present application, all other embodiments obtained by those skilled in the art fall within the scope of the present application without making creative labour.

Figure 1:
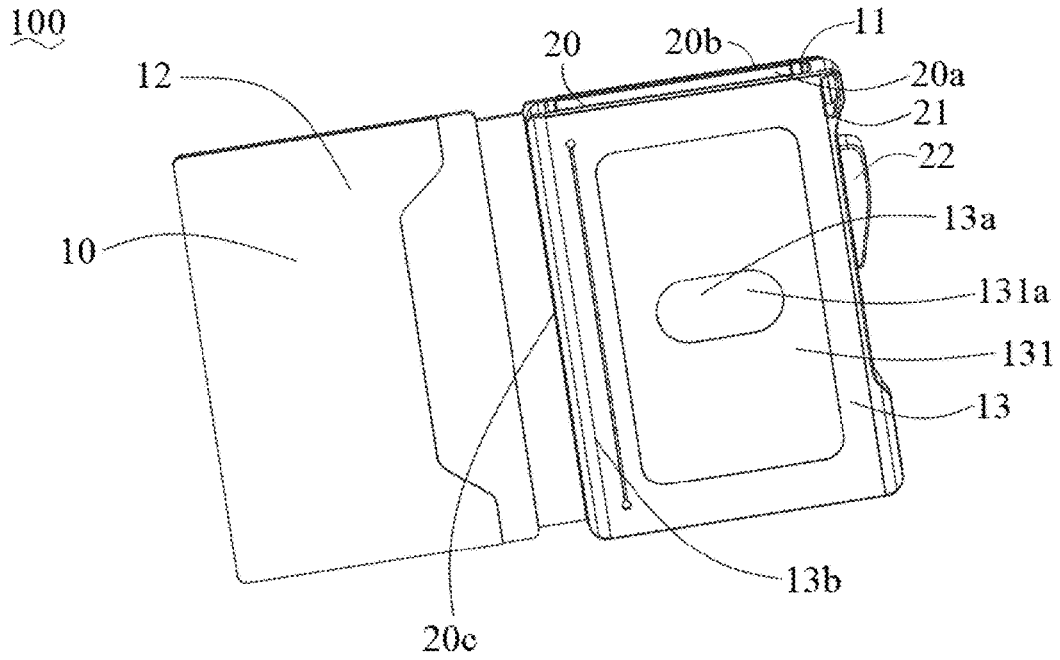
FIG. 1 is a schematic view of a card case in a first opened state according to a first embodiment of the present application.
Figure 2:
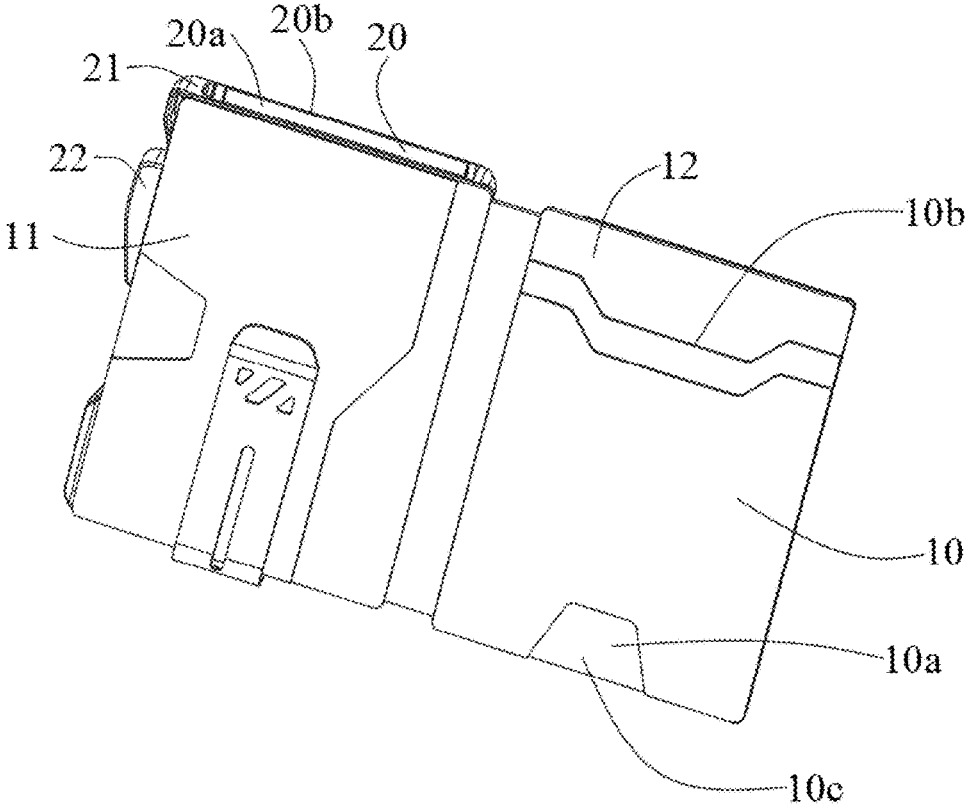
FIG. 2 is a schematic view of the card case in a second opened state according to a first embodiment of the present application.
Figure 3:
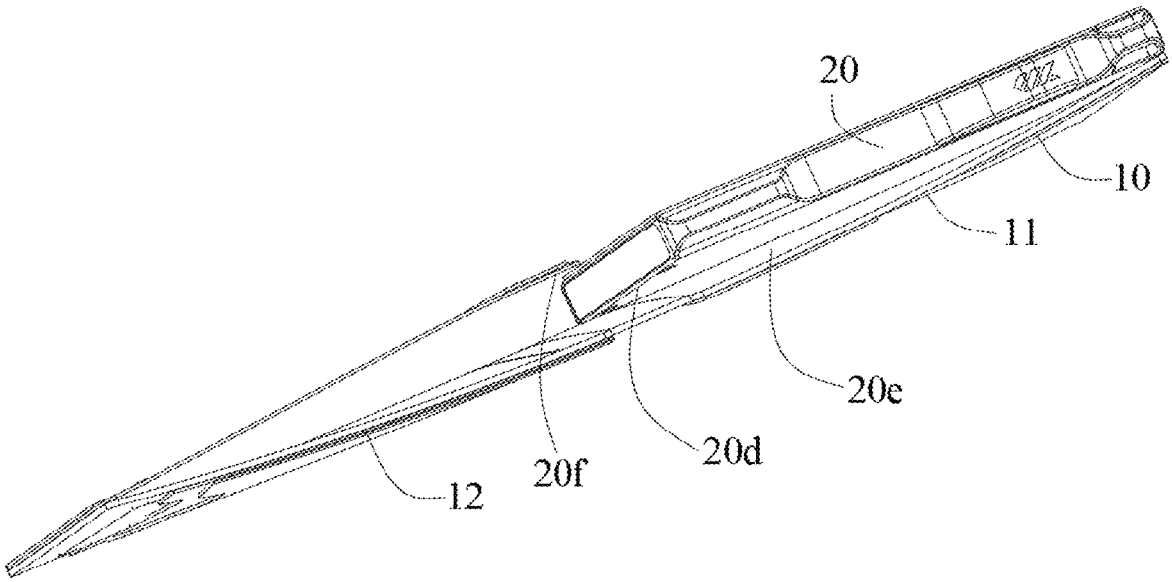
FIG. 3 is a schematic view of the card case in a third opened state according to a first embodiment of the present application.
Figure 4:
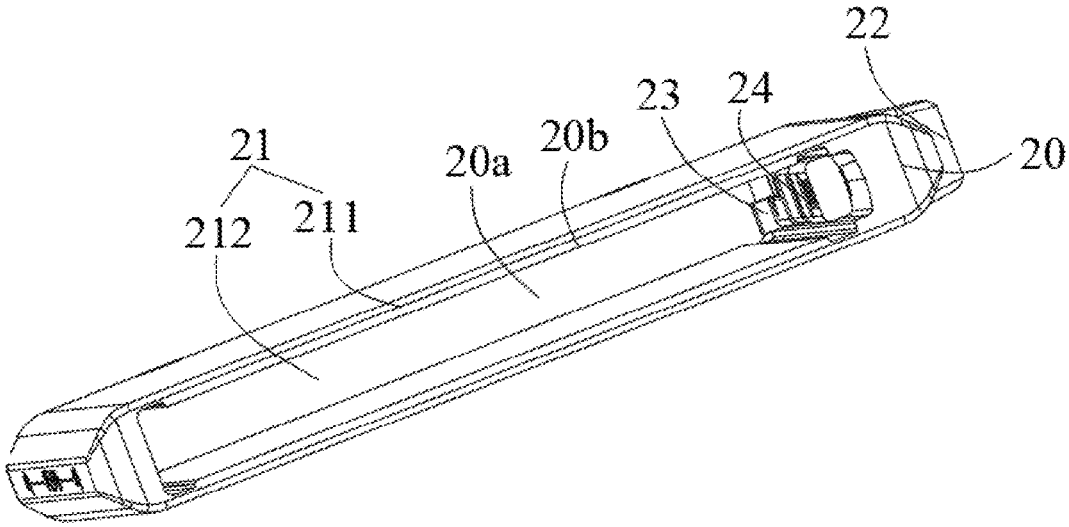
FIG. 4 is a schematic view of a card box of the card case according to a first embodiment of the present application.
Figure 5:
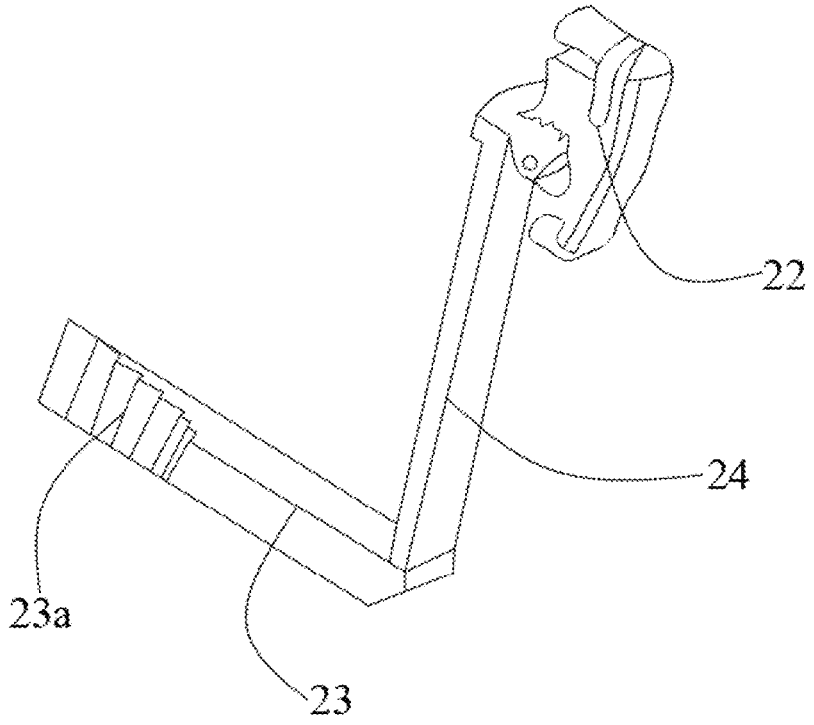
FIG. 5 is a schematic view of an operation member of the card case according to a first embodiment of the present application
Figure 6:
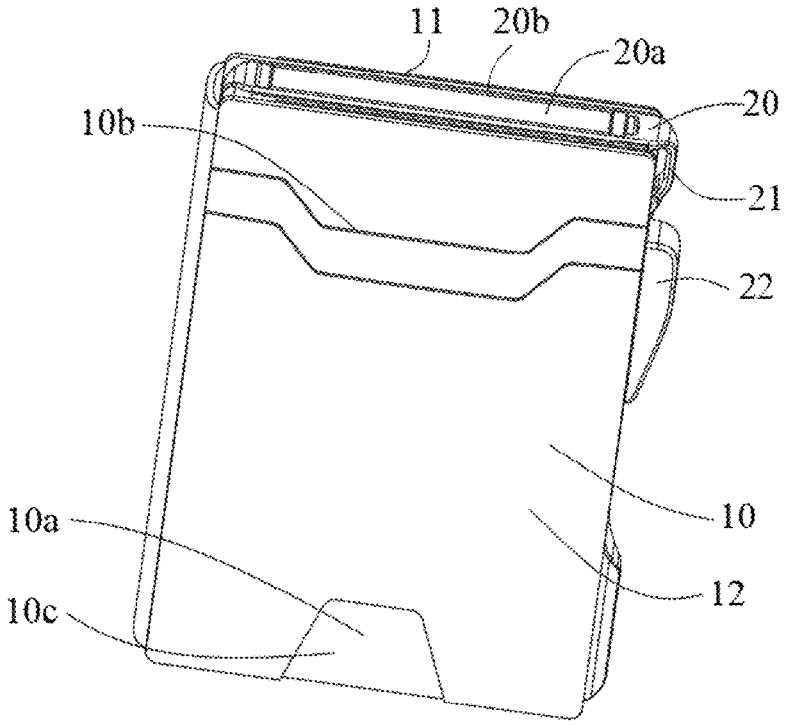
FIG. 6 is a schematic view of the card case in a closed state according to a first embodiment of the present application.
Figure 7:
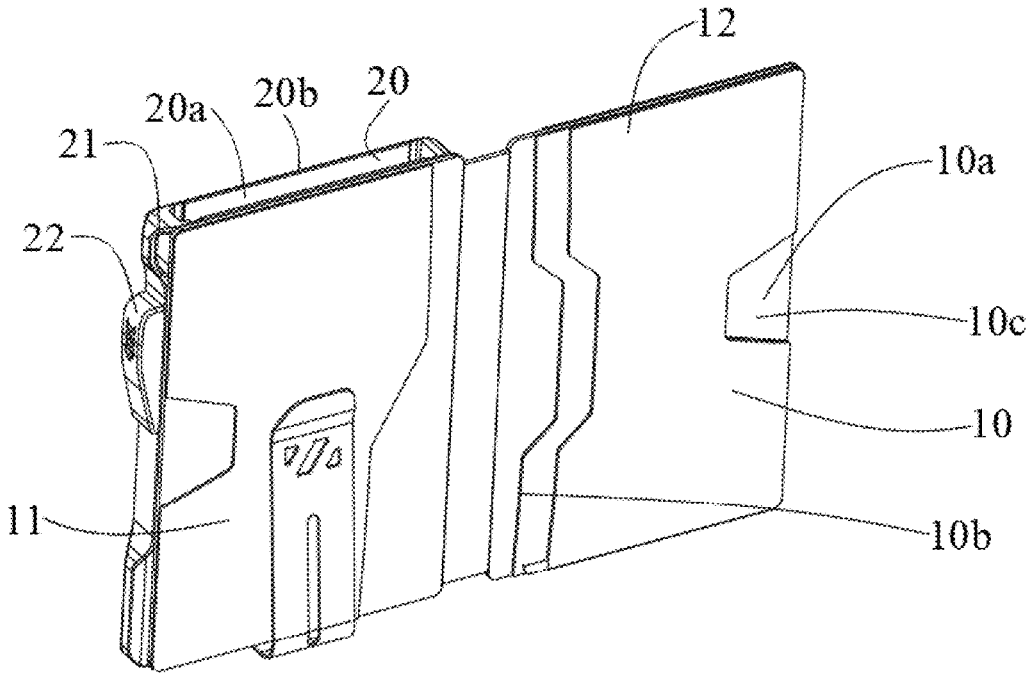
FIG. 7 is a schematic view of the card case in an opened state according to a second embodiment of the present application.
Figure 8:
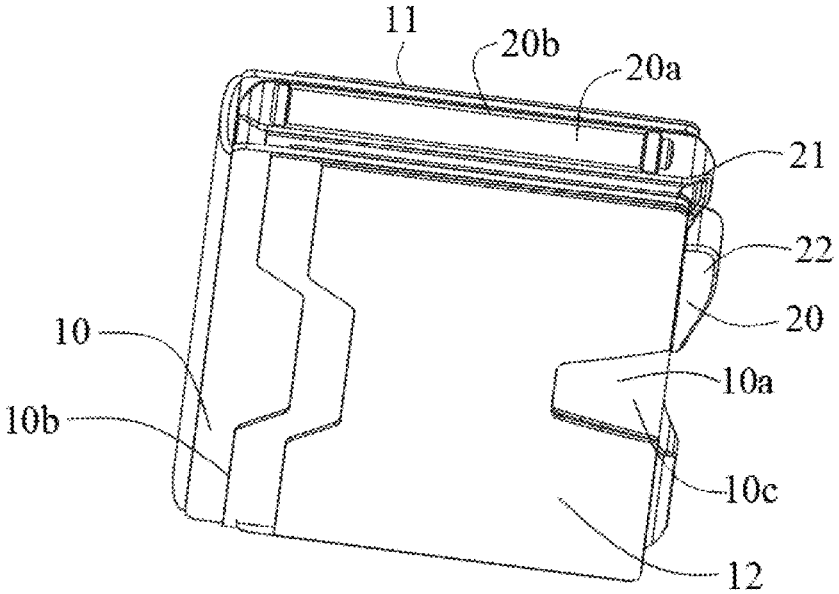
FIG. 8 is a schematic view of a card case in a closed state according to a second embodiment of the present application.

Referring to FIGS. 1 to 8, the present application provides a card case 100, the card case 100 is configured to hold a plurality of cards or a plurality of banknotes, and the card case 100 includes a flexible member 10 and a card box 20, and the card box 20 is provided on an inner side of the flexible member 10.

In the present application, the flexible member 10 is provided with a first holding groove 10*a* and a first opening 10*b*. The first holding groove 10*a* is configured to hold the cards or banknotes. The first opening 10*b* is connected to the first holding groove 10*a*, and a direction faced by the first opening 10*b* is a first direction, so as to facilitate that the cards or banknotes enter into the first holding groove 10*a* through the first opening 10*b*, or, the cards in the first holding groove 10*a* are taken out of the first holding groove 10*a* via the first opening 10*b* to the external environment.

The flexible member 10 includes a first portion 11 and a second portion 12, the first portion 11 and the second portion 12 are flexibly connected, so that the first portion 11 and the second portion 12 are movable with each other, and the first portion 11 and the second portion 12 are able to be opened or closed with each other. When the first portion 11 and the second portion 12 are in the closed state, so as to facilitate reducing the area of the flexible member 10, thereby facilitating the storage of the card case 100. The card box 20 is located between the first portion 11 and the second portion 12 and is exposed to the first portion 11 and the second portion 12 in a lateral direction, so as to facilitate exposure of one side of the card box 20 to the external environment, thereby facilitating the operation member 22 of the card box 20 to be on the side of the card box 20 that is exposed to the external environment.

The operation member 22 of the card box 20 is exposed to the first portion 11 and the second portion 12 and is operable by a user, so as to facilitate the operation member 22 of the card box 20 to be operable by a user when the first portion 11 and the second portion 12 are opened or closed to each other.

The first holding groove 10*a* is opened to the first portion 11 or the second portion 12, and the first opening 10*b* is in communication with the first holding groove 10*a*, so as to facilitate that the first holding is housed on a side of the flexible member 10 away from the card box 20, thereby facilitating that the first holding groove 10*a* is located on an outer surface of the flexible member 10, and the card box 20 is connected to the first portion 11 or the second portion 12. The second opening 20*b* is exposed to the first portion 11 and the second portion 12 for the card passing through, so as to facilitate that the card can be taken out of the card box 20 when both the first portion 11 and the second portion 12 are in the closed state or the opened state.

There are a plurality of the first holding grooves 10*a* located at the first portion 11 and the second portion 12, and the plurality of first holding grooves 10*a* are in the same extension direction or are perpendicular to each other. Since the plurality of first holding grooves 10*a* are provided, the capacity of the flexible member 10 relative to the card is increased, then the capacity of the flexible member 10 to store the card is improved.

The flexible member 10 is provided with a first notch 10*c*, the first notch 10*c* is provided on a side of the first holding groove 10*a* away from the first opening 10*b*, and the first notch 10*c* is in communication with the first holding groove 10*a*, so that when a user needs to take away the card in the first holding groove 10*a*, the user can put a finger into the first notch 10*c* to push out the card in the first holding groove 10*a* through the first opening 10*b*.

The flexible member 10 further includes a third portion 13 provided with a certificate card holding groove 13*a* and a fifth opening 13*b*. The certificate card holding groove 13*a* is used to hold the identification cards or the cards. The fifth opening 13*b* is in communication with the certificate card holding groove 13*a*, so as to allow the identification cards or the cards to be placed in the certificate card holding groove 13*a* through the fifth opening 13*b*, thereby facilitating the storage of the identification cards or the cards in the third portion 13. Optionally, the angle between an opening direction of the fifth opening 13*b* and the second direction ranges from 0° to 285°.

The third portion 13 is provided with a visual window 131 for viewing by the user, which can facilitate the user to observe the types of cards placed in the certificate holding groove 13*a*. The visual window 131 is provided with a second notch 131*a*, when the user needs to take away the card in the certificate holding groove 13*a*, the user can put his finger into the second notch 131*a* to push out the card in the certificate holding groove 13*a* through the fifth opening 13*b*. Optionally, the outer contour of the visible window 131 is of a circular arc, an elongated shape, a square, or a special shaped.

The second direction is the same as or opposite to the first direction; an area of the opening space of the second opening 20*b* is larger or smaller than an area of the opening space of the first opening 10*b*, so as to facilitate that the first holding groove 10*a* is arranged along the vertical direction, thereby facilitating the card to be placed in the first holding groove 10*a* along the vertical direction.

The second direction is perpendicular to the first direction; the area of the opening space of the second opening 20*b* is larger or smaller than the area of the opening space of the first opening 10*b*, so as to facilitate that the first holding groove 10*a* is arranged along the transverse direction, thereby facilitating the placement of card in the first holding groove 10*a* along the horizontal. At this time, there is a height difference between a position where the second opening 20*b* is located and a position where the first opening 10*b* is located, the height difference ranges from 0 to 7 inches, and optionally, the height difference is 0 inches, 2 inches, 3.375 inches, or 7 inches.

In the present application, the card box 20 is provided on the inner side of the flexible member 10, and the card box 20 is connected to the flexible member 10, so as to facilitate that the card box 20 is fixed to the flexible member 10. The card box 20 is provided with the second holding groove 20*a* and the second opening 20*b*, the second holding groove 20*a* is configured to hold the cards or the banknotes; the second opening 20*b* is in communication with the second holding groove 20*a*, and a direction faced by the second opening 20*b* is a second direction, so as to facilitate the entry of the cards or banknotes into the second holding groove 20*a* via the second opening 20*b*, or, the card is taken out of the second holding groove 20*a* to the external environment via the second opening 20*b*.

The second direction and the first direction are parallel to each other, or, the second direction and the first direction form an angle between the second direction and the first direction, and the angle ranges from 0° to 355°, so as to facilitate regulation of the angle between the second opening 20*b* and the first opening 10*b*, and thus control the direction where the card is taken out of the second holding groove 20*a* and the direction where the card is taken out of the first holding groove 10*a*, so as to facilitate that the direction where the card is taken out of the second holding groove 20*a* and the direction where the card is taken out of the first holding groove 10*a* are the same or opposite, which improves the convenience for the card to be taken out of the card case 100, and thereby enabling the card box 20 to be taken out when the flexible member 10 is in the closed state.

In addition, the second holding groove 20*a* is provided on one side of the first holding groove 10*a*, and the first holding groove 10*a* and the second holding groove 20*a* are spaced apart and can be used by the user selectively or synchronously, so as to facilitate the user to simultaneously remove the cards or banknotes from the first holding groove 10*a* and the second holding groove 20*a*, and to improve the convenience for the card to be taken out of the card case 100.

At this time, the card box 20 includes a housing 21, an operation member 22, and a push card member 23. The housing 21 is connected to the flexible member 10. The second holding groove 20*a* is formed by enclosing an inner side wall of the housing 21, and a second opening 20*b* is opened at an end of the housing 21 and in communication with the second holding groove 20*a*. The operation member 22 is movably connected to the housing 21 and operable by the user for adjusting the position of the operation member 22 relative to the housing 21. The operation member 22 is directly or indirectly connected to the push card member 23. The push card member 23 is located in the second holding groove 20*a*, and the push card member 23 adjusts its position with the movement of the operation member 22 to push the card in the second holding groove 20*a*. When the user operates the operation member 22, the operation member 22 pushes the card in the second holding groove 20*a* by the push card member 23 to facilitate the exposure of the card to the second opening 20*b*, thereby improving the convenience for card to be taken out of the card case 100.

The operation member 22 is a push button, a button or a knob. When the operation member 22 is a push button, the push button is arranged along a length direction of the housing 21, the push button is movably connected to the housing 21 and is moved along the length direction of the housing 21, so as to facilitate adjustment of the position of the push button relative to the housing 21. The housing 21 is provided with an elongated hole, and the push button is movable to pass through the long hole, so as to facilitate movement of the push button relative to the housing 21 through the elongated hole, thereby facilitating the push button during movement to drive the push card member 23 to push the card in the second holding groove 20*a*.

When the operation member 22 is a button, the button is movably connected to the housing 21 and moves along the width direction of the housing 21, so as to facilitate adjustment of the position of the button relative to the housing 21, the housing 21 is provided with a through-hole, and the button is movable to pass through the through-hole, so as to facilitate movement of the button relative to the housing 21 through the through-hole, thereby facilitating the button during movement to drive the push card member 23 to push the card in the second holding groove 20*a*.

When the operation member 22 is a knob, the knob is rotatably connected to the housing 21 and rotates relative to the housing 21, so as to facilitate adjustment of the position of the knob relative to the housing 21. The housing 21 is provided with a through-hole, and the button is rotatable to pass through the through-hole, so as to facilitate rotation of the knob relative to the housing 21 through the through-hole, so as to facilitate the knob when rotation to drive the push card member 23 to push the card in the second holding groove 20*a*.

The operation member 22 is provided on a circumferential side of the housing 21, the operation member 22 is provided with an operation end, the operation end is exposed to the housing 21 and is not covered by the flexible member 10, so as to facilitate that the operation end of the flexible member 10 is exposed to the external environment in an opened state or a closed state, avoiding that the cards or banknotes in the card box 20 can only be taken out when the flexible member 10 is in the opened state, thereby improving the convenience for card to be taken out of the card box 20.

The push card member 23 is swingably connected to the housing 21 and swings within the second holding groove 20*a*, so as to facilitate adjustment of the position of the push card member 23 relative to the housing 21 to push the card within the second holding groove 20*a*, thereby facilitating exposure of the card within the second holding groove 20*a* to the second opening 20*b*, and optionally, the push card member 23 is connected to the housing 21 by hinge joint, so as to enable the push card member 23 to be swingable relative to the housing 21.

The push card member 23 is connected to a connection member 24, the connection member 24 is located between the push card member 23 and the operation member 22, and connects the push card member 23 with the operation member 22. The connection member 24 drives the swing of the push card member 23 under the driving of the operation member 22, so as to enable the operation member 22 to achieve the swing of the push card member 23 through the connection member 24. The push card member 23 is provided with a stepped groove 23*a*, a bottom of the stepped groove 23*a* is configured to support a plurality of cards. A plurality of cards are spaced apart by the stepped groove 23*a*.

The housing 21 includes a first main body 211 and a bottom cover 212, the bottom cover 212 is connected to the first main body 211 and forms a second holding groove 20*a* with the first main body 211, and the inner contour of the second holding groove 20*a* is adapted to the cards, so as to facilitate the first main body 211 to hold the cards. Optionally, the first main body 211 is a hollow tubular body, and the first main body 211 is of a square, a special shaped, or a round, and the first main body 211 is made of aluminium extruded tube, or, the first main body 211 is formed by processing metal parts.

The card box 20 is connected to the first portion 11, and a first money clip groove 20*c* is formed between the card box 20 and the first portion 11, the first money clip groove 20*c* is used for clamping the banknotes. The first money clip groove 20*c* is provided with a third opening 20*d*, the third opening 20*d* faces the second portion 12, so as to allow the banknotes to be placed in the first money clip groove 20*c* through the third opening 20*d*, thereby facilitating the storage of the banknotes. Optionally, the first money clip groove 20*c* may also be formed by a holster connected to the second portion 12.

Alternatively, the card box 20 is connected to the second portion 12, and a second money clip groove 20*e* is formed between the card box 20 and the second portion 12, the second money clip groove 20*e* is used for clamping the banknotes. The second money clip groove 20*e* is provided with a fourth opening 20*f*, the fourth opening 20*f* faces the first portion 11, so as to allow the banknotes to be placed in the second money clip groove 20*e* through the fourth opening 20*f*, thereby facilitating the storage of the banknotes. Optionally, the second money clip groove 20*e* may also be formed by a holster connected to the second portion 12.

Compared to the prior art, the present application has a beneficial effect:

The present application is to provide a card case 100. A flexible member 10 is provided with a first holding groove 10*a* and a first opening 10*b*, the first holding groove 10*a* is configured to hold cards or banknotes, and the first opening 10*b* is in communication with the first holding groove 10*a*, and a direction faced by the first opening 10*b* is a first direction; a card box 20 is connected to the flexible member 10, the card box 20 is provided with a second holding groove 20*a* and a second opening 20*b*, and the second holding groove 20*a* is configured to hold cards or banknotes; the second opening 20*b* is in communication with the second holding groove 20*a*, and a direction faced by the second opening 20*b* is a second direction, and the second direction is parallel to the first direction, or an angle is formed between the second direction and the first direction, and the angle is from 0° to 355°, so as to adjust the angle between the second opening 20*b* and the first opening 10*b*, and thus control a direction where the card is taken out of the second groove 20*a* and a direction where the card is taken out of the first groove 10*a*, so that the direction where the card is taken out of the second groove 20*a* and the direction where the card is taken out of the first groove 10*a* are the same or the opposite, which improves the convenience for card to be taken out of the card case 100, and thus realizes that the card is taken out of the card box 20 when the flexible member 10 is in a closed state.

In the above embodiments, the description of each embodiment has its own focus, and the parts that are not detailed in a certain embodiment can be seen in the relevant description of other embodiments.

In the description of the present application, the terms "first" and "second" are used for descriptive purposes only and are not to be understood as indicating or implying relative importance or implicitly specifying the number of technical features indicated. As a result, a feature defined with "first" or "second" may either expressly or implicitly include one or more features.

Herein, specific examples of the principle and implementation of the application for the elaboration of the above examples are only configured to help understand the application of the method and its core ideas; and, for those skilled in the art, based on the application of the idea, in the specific implementation of the scope of application will have to change, in summary, the contents of this specification should not be construed as a limitation on the present application.

What is claimed is:

1. A card case, comprising:

a flexible member, provided with a first holding groove and a first opening, wherein the first holding groove is configured to hold cards or banknotes, and the first opening is in communication with the first holding groove, and a direction faced by the first opening is a first direction;

a card box, connected to the flexible member, wherein the card box is provided with a second holding groove and a second opening, and the second holding groove is configured to hold cards or banknotes; wherein the second opening is in communication with the second holding groove, and a direction faced by the second opening is a second direction, and the second direction is parallel to the first direction, or an angle is formed between the second direction and the first direction, and the angle is from 0° to 355°;

the flexible member comprises a first portion and a second portion, the first portion and the second portion are flexibly connected and are opened or closed to each other;

when the first portion and the second portion are in a closed state, and the card box is located between the first portion and the second portion and is exposed to the first portion and the second portion along a lateral direction;

an operation member of the card box is exposed to the first portion and the second portion, and is operable by a user;

the first holding groove is opened in the first portion or the second portion, and the first opening is in communication with the first holding groove;

the card box is connected to the first portion or the second portion, and the second opening is exposed in the first portion and the second portion for card insertion;

the card box is connected to the first portion, a first money clip groove is formed between the card box and the first portion, and the first money clip groove is configured to hold banknotes, the first money clip groove is provided with a third opening towards the second portion; or the card box is connected to the second portion, a second money clip groove is formed between the card box and the second portion, and the second money clip groove is configured to hold banknotes, and the second money clip groove is provided with a fourth opening towards the first portion.

2. The card case according to claim 1, wherein the second direction is the same as or opposite to the first direction, and an area of an opening space of the second opening is larger or smaller than an area of an opening space of the first opening; and the second holding groove is provided on a side of the first holding groove, and the first holding groove and the second holding groove are arranged at intervals and are used by a user selectively or synchronously.

3. The card case according to claim 1, wherein the second direction and the first direction are perpendicular to each other, and an area of an opening space of the second opening is larger or smaller than an area of an opening space of the first opening; and the second holding groove is provided on a side of the first holding groove, and the first holding groove and the second holding groove are spaced apart and are used by a user selectively or synchronously.

4. The card case according to claim 1, wherein the card box comprises a housing, an operation member, and a push card member;

the housing is connected to the flexible member, an inner side wall of the housing encloses to form the second holding groove, and the second opening is opened at an end of the housing and in communication with the second holding groove;

the operation member is movably connected to the housing and operable by a user, and the operation member is directly connected or indirectly connected to the push card member; and the push card member is located in the second holding groove, a position of the push card member is adjusted along with a movement of the operation member to push a card in the second holding groove.

5. The card case according to claim 4, wherein the operation member is provided on a circumferential side of the housing, and the operation member is provided with an operation end, the operation end is exposed to the housing and not covered by the flexible member.

6. The card case according to claim 4, wherein the push card member is swingably connected to the housing and swings within the second holding groove to push the card in the second holding groove;

connection member is located between the push card member and the operation member and is configured to connect the push card member to the operation member;

the connection member is driven by the operation member to drive the push card member to swing; and the push card member is provided with a stepped groove, and a bottom of the stepped groove is configured to support a plurality of cards.

7. The card case according to claim 4, wherein the housing comprises a first main body and a bottom cover, the bottom cover is connected to the first main body and forms the second holding groove with the first main body;

the first main body is a hollow tubular body, and the first main body is of square, special-shaped or round; and the first main body is formed by cutting aluminium extruded tube; or, the first main body is formed by processing metal parts.

8. A card case, comprising:

a flexible member, provided with a first holding groove and a first opening, wherein the first holding groove is configured to hold cards or banknotes, and the first opening is in communication with the first holding groove, and a direction faced by the first opening is a first direction;

a card box, connected to the flexible member, wherein the card box is provided with a second holding groove and a second opening, and the second holding groove is configured to hold cards or banknotes; wherein the second opening is in communication with the second holding groove, and a direction faced by the second opening is a second direction, and the second direction and the first direction are the same direction or opposite directions;

the flexible member comprises a first portion and a second portion, the first portion and the second portion are flexibly connected and are opened or closed to each other;

when the first portion and the second portion are in a closed state, and the card box is located between the first portion and the second portion and is exposed to the first portion and the second portion along a lateral direction;

the card box is connected to the first portion, a first money clip groove is formed between the card box and the first portion, and the first money clip groove is configured to hold banknotes, and the first money clip groove is provided with a third opening towards the second portion; or the card box is connected to the second portion, a second money clip groove is formed between the card box and the second portion, and the second money clip groove is configured to hold banknotes; and the second money clip groove is provided with a fourth opening towards the first portion.

9. The card case according to claim 8, wherein the flexible member further comprises a third portion provided with a certificate card holding groove, and the certificate card holding groove is configured to hold identification cards or cards.

10. The card case according to claim 6, wherein the third portion is connected to the card box.

11. The card case according to claim 10, wherein the third portion is provided with a fifth opening, the fifth opening is in communication with the certificate card holding groove, and the angle between an opening direction of the fifth opening and the second direction ranges from 0° to 285°.

12. The card case according to claim 8, wherein the card box comprises a housing, an operation member, and a push card member;

the housing is connected to the flexible member;

the second holding groove is formed by enclosing an inner side wall of the housing, and a second opening is opened at an end of the housing and in communication with the second holding groove;

the operation member is movably connected to the housing and operable by a user;

the operation member is directly or indirectly connected to the push card member;

the push card member is located in the second holding groove, and the push card member adjusts a position of the push card member with the movement of the operation member to push the cards in the second holding groove;

the operation member is a push button, a button or a knob;

when the operation member is a push button, the push button is movably connected to the housing and is moved along a length direction of the housing;

when the operation member is a button, the button is movably connected to the housing and moves along a width direction of the housing; and when the operation member is a knob, the knob is rotatably connected to the housing and rotates relative to the housing.

13. A card case, comprising:

a flexible member, provided with a first holding groove and a first opening, wherein the first holding groove is configured to hold cards or banknotes, and the first opening is in communication with the first holding groove, and a direction faced by the first opening is a first direction;

a card box, connected to the flexible member, wherein the card box is provided with a second holding groove and a second opening, and the second holding groove is configured to hold cards or banknotes; wherein the second opening is in communication with the second holding groove, and a direction faced by the second opening is a second direction; and a third portion, provided with a certificate card holding groove, and the certificate card holding groove is configured to hold identification cards or cards;

the card box is connected to the first portion, a first money clip groove is formed between the card box and the first portion, and the first money clip groove is configured to hold banknotes, and the first money clip groove is provided with a third opening towards the second portion; or the card box is connected to the second portion, a second money clip groove is formed between the card box and the second portion, and the second money clip groove is configured to hold banknotes; and the second money clip groove is provided with a fourth opening towards the first portion.

14. The card case according to claim 13, wherein the card box comprises a housing, an operation member, and a push card member;

the housing is connected to the flexible member;

the second holding groove is formed by enclosing an inner side wall of the housing, and a second opening is opened at an end of the housing and in communication with the second holding groove;

the operation member is movably connected to the housing and operable by a user;

the operation member is directly or indirectly connected to the push card member;

the push card member is located in the second holding groove, and the push card member adjusts a position of the push card member with the movement of the operation member to push the cards in the second holding groove;

the operation member is a push button, a button or a knob;

when the operation member is a push button, the push button is movably connected to the housing and is moved along a length direction of the housing;

when the operation member is a button, the button is movably connected to the housing and moves along a width direction of the housing; and when the operation member is a knob, the knob is rotatably connected to the housing and rotates relative to the housing.

* * * * *